US010297214B2

(12) United States Patent
Lin

(10) Patent No.: US 10,297,214 B2
(45) Date of Patent: May 21, 2019

(54) HIGH RESOLUTION DEMULTIPLEXER DRIVER CIRCUIT

(71) Applicant: Wuhan China Star Optoelectronics Technology Co., Ltd., Wuhan (CN)

(72) Inventor: Jianhong Lin, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 254 days.

(21) Appl. No.: 15/119,726

(22) PCT Filed: Jul. 20, 2016

(86) PCT No.: PCT/CN2016/090581
§ 371 (c)(1),
(2) Date: Aug. 18, 2016

(87) PCT Pub. No.: WO2017/219420
PCT Pub. Date: Dec. 28, 2017

(65) Prior Publication Data

US 2018/0182324 A1 Jun. 28, 2018

(30) Foreign Application Priority Data

Jun. 23, 2016 (CN) ..... 2016 1 0472865

(51) Int. Cl.
*G09G 3/36* (2006.01)
*G09G 3/3225* (2016.01)

(52) U.S. Cl.
CPC ..... *G09G 3/3614* (2013.01); *G09G 3/3225* (2013.01); *G09G 3/36* (2013.01);
(Continued)

(58) Field of Classification Search
CPC ..... G09G 3/3614; G09G 2310/0297; G09G 2310/0254; G09G 2300/0452;
(Continued)

(56) References Cited

U.S. PATENT DOCUMENTS

2012/0113154 A1* 5/2012 Ge ..... G09G 3/3614 345/690
2014/0198135 A1* 7/2014 Eom ..... G09G 3/3275 345/690

(Continued)

FOREIGN PATENT DOCUMENTS

CN 104700794 A 6/2015
KR 20140109697 A * 9/2014
KR 1020140109697 A 9/2014

*Primary Examiner* — Koosha Sharifi-Tafreshi
(74) *Attorney, Agent, or Firm* — Leong C. Lei

(57) ABSTRACT

The invention provides a high resolution demultiplexer (demux) driver circuit, comprising: a plurality of scan lines connected respectively to sub-pixels of corresponding column, a plurality of data lines connected respectively to sub-pixels of corresponding row, and a plurality of multiplexer (mux) modules; each mux module comprising two thin film transistors, with gates connected respectively to first and second shunt control signals, sources connected to same data signal, and drains connected respectively to data line near the two same color sub-pixel row; controlling the polarity of each data signal to control each sub-pixel row except the first and last rows to display in horizontal direction following the polarity distribution of alternating positive-positive and negative-negative. The invention does not need to change the data signal voltage in a power-saving mode, and achieves high power-saving efficiency. The number of control signals and the frequency controlling control signals are reduced for further power-saving.

14 Claims, 8 Drawing Sheets

(52) U.S. Cl.
CPC ... *G09G 3/3648* (2013.01); *G09G 2310/0297* (2013.01); *G09G 2330/021* (2013.01)

(58) Field of Classification Search
CPC ..... G09G 2330/021; G09G 3/3688; G09G 3/3648; G09G 3/3677; G09G 2310/0286; G09G 2310/0291; G09G 2300/0426; G09G 3/3685; G09G 2300/0823
USPC ..... 345/54, 79, 96, 204, 209
See application file for complete search history.

(56) References Cited

U.S. PATENT DOCUMENTS

2015/0161927 A1* 6/2015 Hekstra ..... G09G 3/3614 345/209
2016/0322008 A1* 11/2016 Sang ..... G09G 3/3275

* cited by examiner

HIGH RESOLUTION DEMULTIPLEXER DRIVER CIRCUIT

BACKGROUND OF THE INVENTION

1. Field of the Invention

The present invention relates to the field of display, and in particular to a high resolution demultiplexer (demux) driver circuit.

2. The Related Arts

The panel display devices, such as, liquid crystal display (LCD) and organic light-emitting diode (OLED) display, comprise a plurality of pixels arranged in an array. Each pixel usually comprises three sub-pixels of red, green and blue respectively. Each sub-pixel is controlled by a gate line and a data line. The gate line is to control the sub-pixel for conduction state, i.e., ON and OFF. The data line is to apply different data voltages to the sub-pixel so that the sub-pixel displays different grayscale to achieve full color display.

As the recent development of high pixel per inch (PPI) panel, more and more panels of higher resolution consume more power due to heavier load and higher frequency. One of the major power consumption comes from the design of the demultiplexer (demux). For high resolution design, because the charging time for demux becomes short, the demux changes from 1-to-many to 1-to-2. For example, for small-size panel with resolution as high as 4K, the 1-to-2 demux is used. Because the PPI is high enough so that a power-saving mode can be activated to cut the resolution to half for the signal line in the Y-direction to reduce the power consumption.

Refer to FIG. 1. FIG. 1 is a schematic view showing the circuit of a known 1-to-2 demux. Based on the known RGB display panel, the circuit of the display panel is of a regular specification, and row scan lines G1, G2, . . . , are connected respectively to sub-pixels of corresponding rows, and data lines D1, D2, . . . , are connected respectively to sub-pixels of corresponding columns. Each sub-pixel is connected through a corresponding thin film transistor (TFT) corresponding to the row of which the sub-pixel belongs to and the data line corresponding to the row of which the sub-pixel belongs to and the data line corresponding to the column of which the sub-pixel belongs to. The circuit of the demux comprises a plurality of multiplexer (mux) modules. Take the mux module 10 as example. The mux module 10 comprises two TFTs, with the gates connected respectively to a first shunt control signal demux1 and a second shunt control signal demux2, the sources connected to the same data signal Data1 (+), i.e., a voltage of the same polarity from the data integrated circuit (IC) signal, and the drains connected respectively to data line D1 and data line D3.

Refer to FIG. 2 and FIG. 3. FIG. 2 is a schematic view showing the power-saving mode signal and circuit of a known 1-to-2 demux circuit, and FIG. 3 a schematic view showing the driving signal in power-saving mode signal of a known 1-to-2 demux circuit. When the power-saving mode is activated, two pixels are considered as a smallest unit (each pixel comprising three R/G/B sub-pixels in FIG. 2). Therefore, the resolution in Y direction is cut to half, as shown FIG. 2, wherein two dash line boxes become the smallest unit, and the levels for the R/G/B color are L240/L127/L30 respectively. The level indicates the index standard for the pixel luminance intensity. In general, for 8-bit RGB color space, 256 levels are used respectively to represent red, green and blue. That is, each color ranges between [0, 255]. In FIG. 2, the levels for R/G/B are 240, 127 and 30 respectively. At this point, the related signals are shown in FIG. 3, comprising: G1 (gate signal), Data1 (+), Data2 (−), Data3 (+), first shunt control signal Demux1 and second shunt control signal Demux2. Although the adjacent same color (with two pixels as the smallest unit) has the same level, the data signal still requires changes in voltage difference. Hence, a large amount of power consumption still incurs.

SUMMARY OF THE INVENTION

The object of the present invention is to provide a high resolution demultiplexer driver circuit, to improve power saving efficiency in a power-saving mode.

To achieve the above object, the present invention provides a high resolution demultiplexer (demux) driver circuit, which comprises: a plurality of scan lines connected respectively to rows of sub-pixels, a plurality of data lines connected respectively to columns of sub-pixels, and a plurality of multiplexer (mux) modules; each mux module comprising two thin film transistors (TFTs), with the gates connected respectively to a first shunt control signal and a second shunt control signal, the sources connected to a same data signal, and the drains connected respectively to the data of two adjacent columns of sub-pixel of same color; controlling the polarity of each data signal to control each sub-pixel column except the first column and the last column to display in the horizontal direction following the polarity distribution of alternating positive-positive and negative-negative.

In an embodiment, the driver circuit is connected to and drives an RGB-based display panel.

In an embodiment, when the driver circuit operates in power-saving mode, the levels for each sub-pixel color R/G/B are 240, 127 and 30 respectively.

In an embodiment, when the driver circuit operates in power-saving mode, the first shunt control signal and the second shunt control signal are different.

In an embodiment, when the driver circuit operates in power-saving mode, the first shunt control signal and the second shunt control signal are the same.

In an embodiment, within the duration of each gate signal, the mux module switches on and off once.

In an embodiment, within the duration of each gate signal, the mux module switches on and off twice.

In an embodiment, each sub-pixel column except the first column and the last column displays in the horizontal direction following the polarity distribution of t positive-positive followed by negative-negative.

In an embodiment, each sub-pixel column except the first column and the last column displays in the horizontal direction following the polarity distribution of negative-negative followed by positive-positive.

In an embodiment, the polarity of each data signal is distributed following alternating positive and negative.

The present invention also provides a high resolution demultiplexer (demux) driver circuit, which comprises: a plurality of scan lines connected respectively to columns of sub-pixels, a plurality of data lines connected respectively to rows of sub-pixels, and a plurality of multiplexer (mux) modules; each mux module comprising two thin film transistors (TFTs), with the gates connected respectively to a first shunt control signal and a second shunt control signal, the sources connected to a same data signal, and the drains connected respectively to the data of two adjacent columns of sub-pixels of same color; controlling the polarity of each data signal to control each sub-pixel column except the first column and the last column to display in the horizontal direction following the polarity distribution of alternating positive-positive and negative-negative; wherein the driver circuit being connected to and driving an RGB-based display panel; the polarity of each data signal being distributed following alternating positive and negative.

Compared to the known techniques, the present invention provides the following advantages: the present invention provides a high resolution demux driver circuit, wherein the data signal does not change voltage in a power-saving mode. Therefore, a high power-saving efficiency can be achieved. Moreover, the number of control signals is reduced as well as the frequency controlling the control signals for further power-saving.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
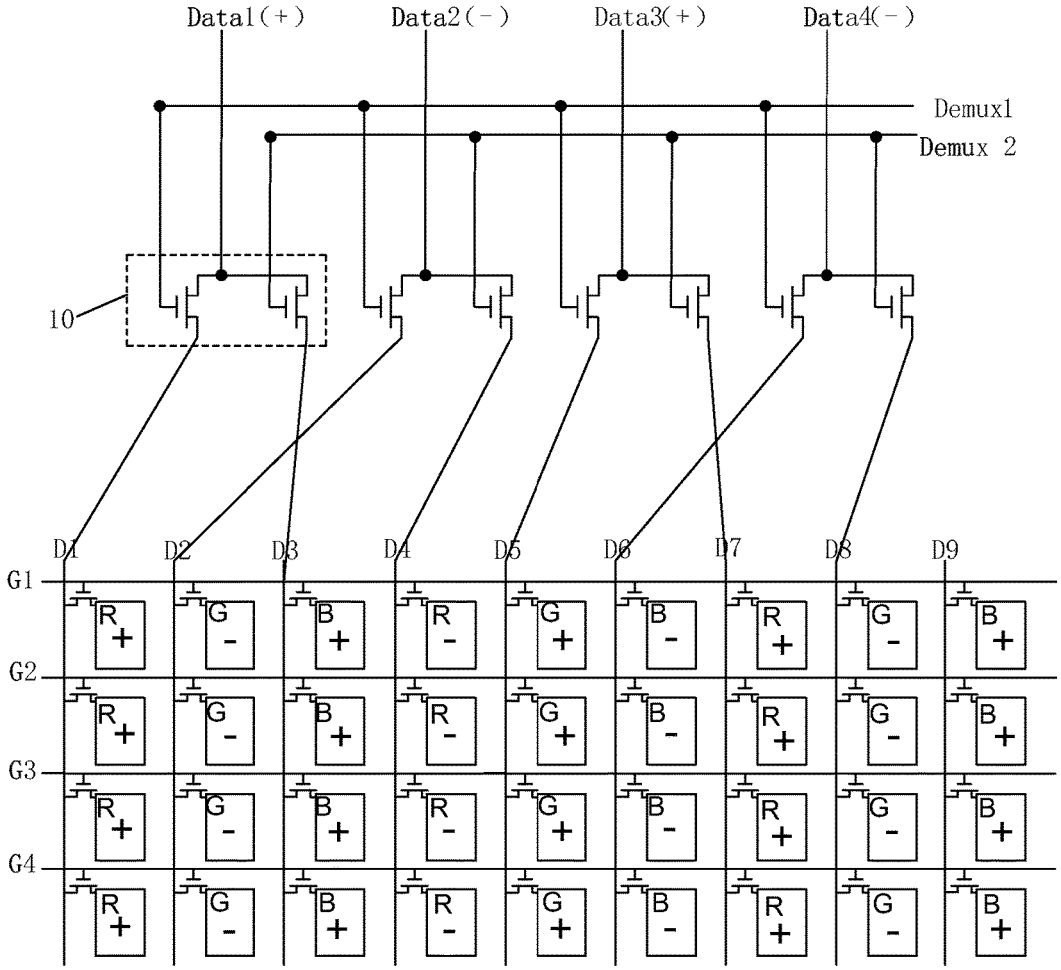
(Prior Art) Fig. 1
FIG. 1 is a schematic view showing the circuit of a known 1-to-2 demux.
Figure 2:
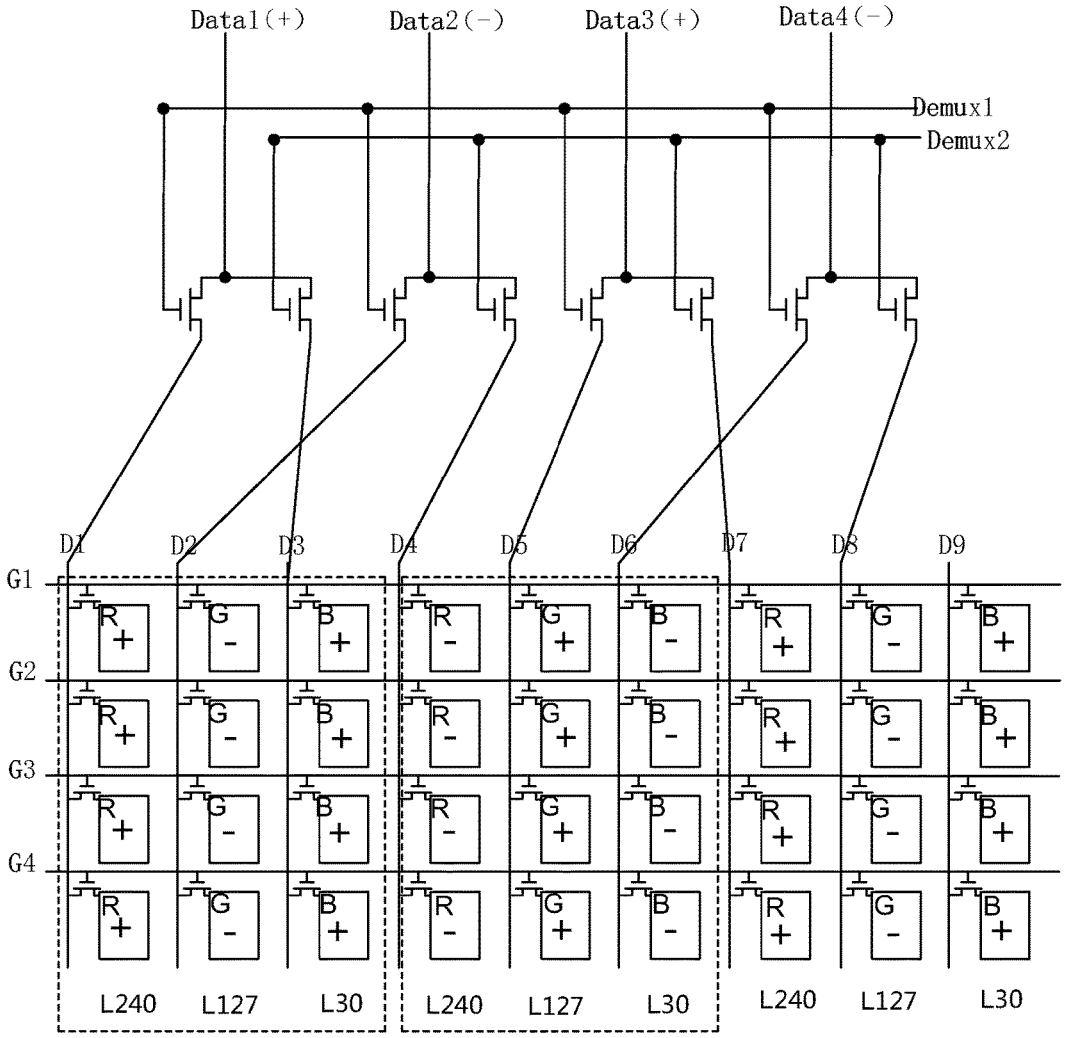
(Prior Art) Fig. 2
FIG. 2 is a schematic view showing the power-saving mode signal and circuit of a known 1-to-2 demux.
Figure 3:
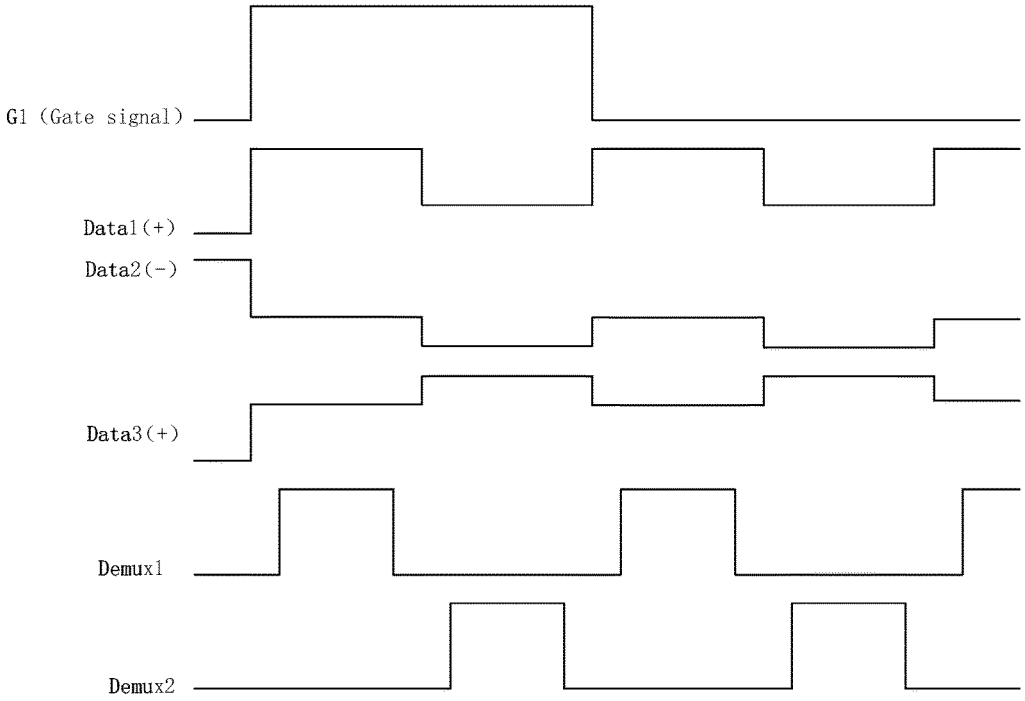
(Prior Art) Fig. 3
FIG. 3 is a schematic view showing the driving signals under the power-saving mode for a known 1-to-2 demux.
Figure 4:
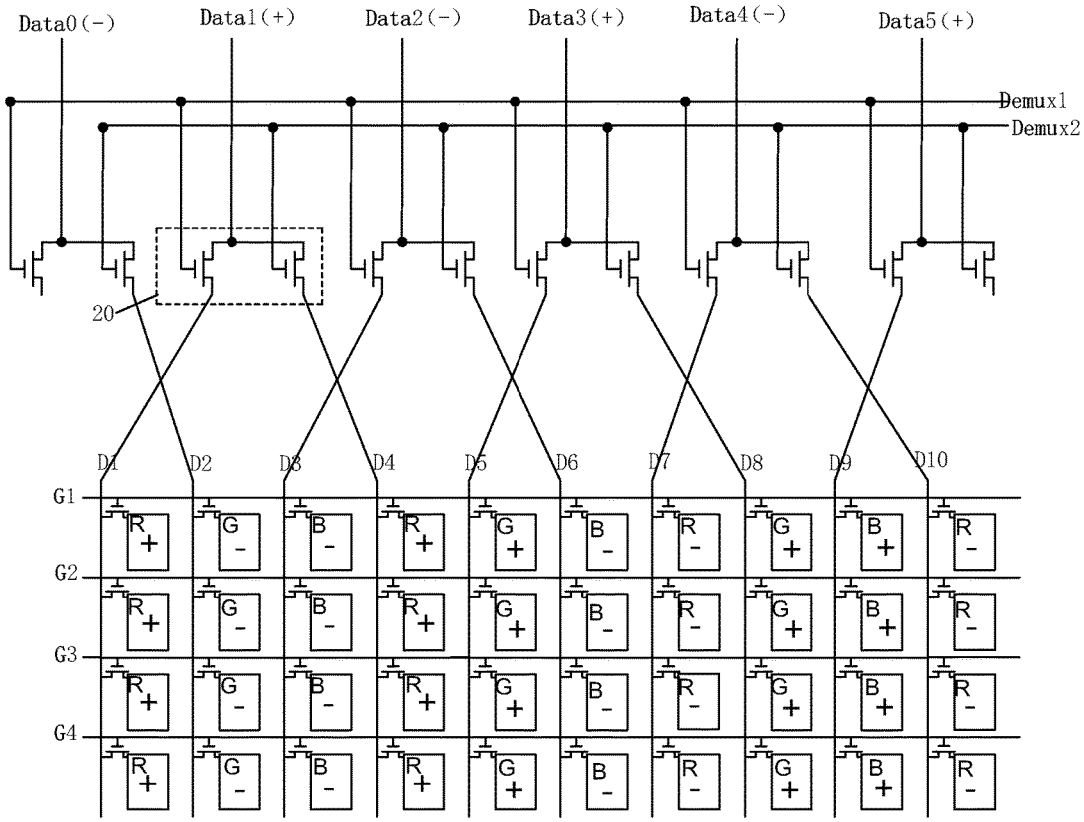
FIG. 4 is a schematic view showing the circuit of the high resolution demux driver circuit provided by a preferred embodiment of the present invention.

Refer to FIG. 4. The preferred embodiment of high resolution demultiplexer (demux) driver circuit provided by the present invention comprises: a plurality of scan lines G1, G2, . . . , connected respectively to rows of sub-pixels, a plurality of data lines D1, D2, . . . , connected respectively to columns of sub-pixels, and a plurality of multiplexer (mux) modules 20; each mux module 20 comprising two thin film transistors (TFTs), with the gates connected respectively to a first shunt control signal Demux1 and a second shunt control signal Demux2, the sources connected to a same data signal, and the drains connected respectively to the data lines of two adjacent columns of sub-pixels of same color to achieve using the same data signal to perform 1-to-2 demultiplexing; the drains of the mux modules 20 at the first and the last columns without near same color sub-pixel columns being disposed as vacant; controlling the polarity of each data signal Data0, Data1, . . . , to control each sub-pixel column except the first column and the last column to display in the horizontal direction following the polarity distribution of alternating positive-positive and negative-negative. The display panel formed by the sub-pixel array can be a known RGB-based RGB display panel, and the circuit of the display panel is of regular specification.

In the 1-to-2 demux design of the present invention, the voltages of Data IC signal of the same polarity are supplied respectively to the two data lines of the same color near the display area by two TFT element switches to form the $++^{--}++^{--}$ . . . polarity display format in the horizontal direction. Also, with the display frequency cut by half, two demux modules can use the same signal, or different signals. By the new arrangement of the demux, the two signals of the same color and nearby can be controlled by the same IC signals. When the present invention is in the power-saving mode (Y direction resolution is cut by half), the requirements for the same color signals are consistent, and the same IC signal voltage can be used for controlling, without the need to change the voltage so as to achieve power saving.

Figure 5:
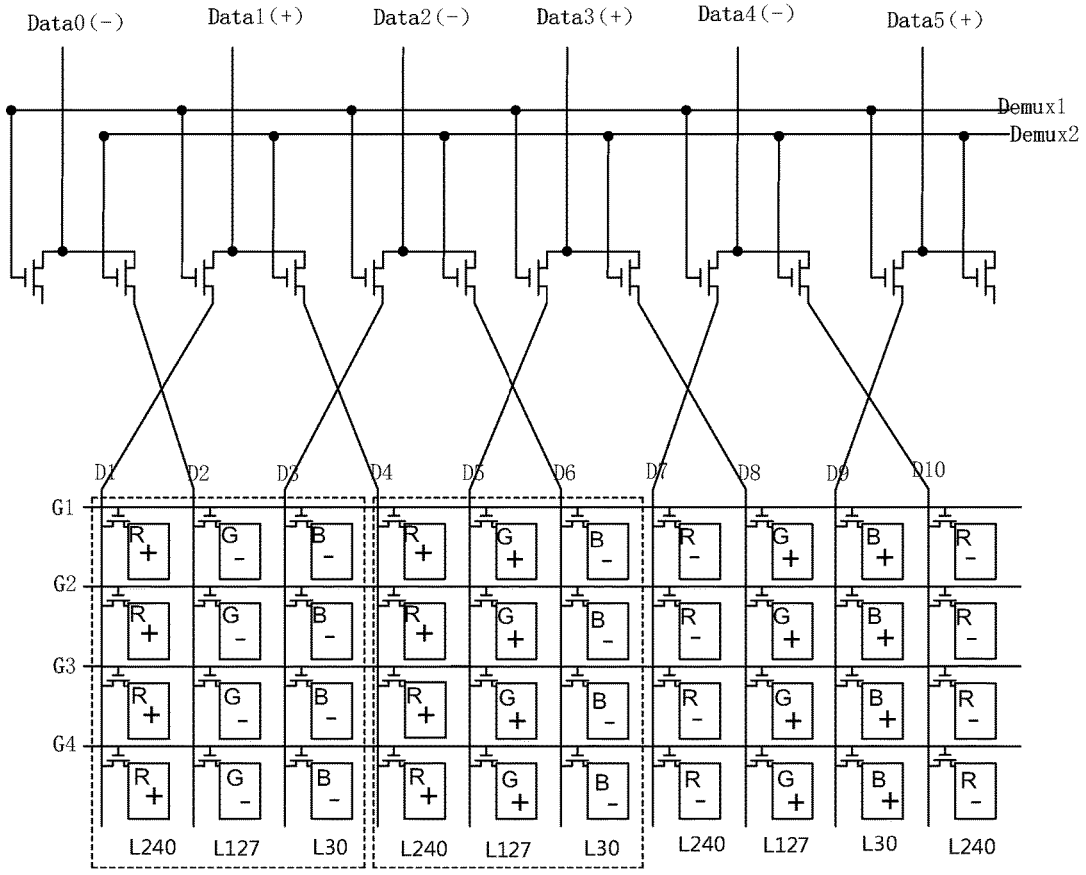
FIG. 5 is a schematic view showing the power-saving mode signal and circuit of the high resolution demux driver circuit provided by a preferred embodiment of the present invention.

Refer to FIG. 5, as well as FIG. 4. FIG. 5 is a schematic view showing the power-saving mode signal and circuit of the high resolution demux driver circuit of the preferred embodiment. As seen in FIG. 4, two nearby pixels of the same color are provided by the same IC signals (Data1-Data4). Therefore, in the power-saving mode (Y direction resolution is cut by half), as shown in FIG. 5, the two dash line boxes are the smallest unit, and the levels of R/G/B are L240/L127/L30 respectively.

Figure 6:
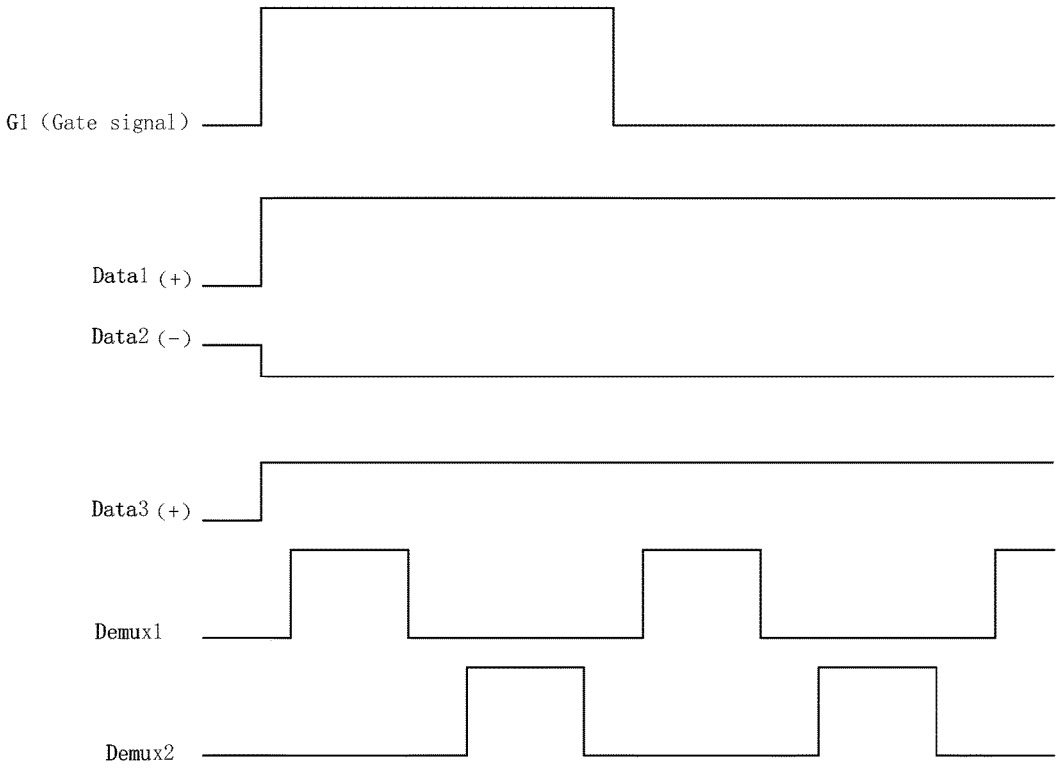
FIG. 6 is a schematic view showing the first driving signal under the power-saving mode for the high resolution demux driver circuit provided by a preferred embodiment of the present invention.

Refer to FIG. 6. FIG. 6 is a schematic view showing the first driving signal under the power-saving mode for the high resolution demux driver circuit provided by a preferred embodiment of the present invention. As seen in FIG. 6, the data signal does not need to change the voltage, wherein the demux is not shared, and both Demux1 and Demux2 are used.

Figure 7:
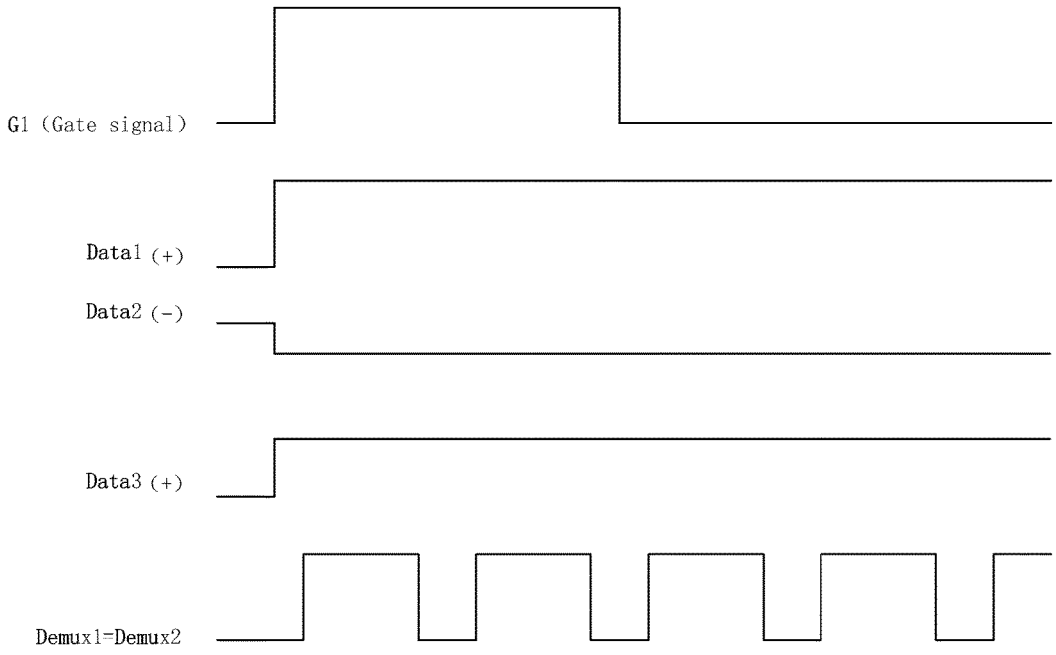
FIG. 7 is a schematic view showing the second driving signal under the power-saving mode for the high resolution demux driver circuit provided by a preferred embodiment of the present invention.

Refer to FIG. 7. FIG. 7 is a schematic view showing the second driving signal under the power-saving mode for the high resolution demux driver circuit provided by a preferred embodiment of the present invention. As seen in FIG. 7, Demux1 and Demux2 are shared, and are the same signal. Also, within the duration of each gate signal, the mux module switches on and off twice.

Figure 8:
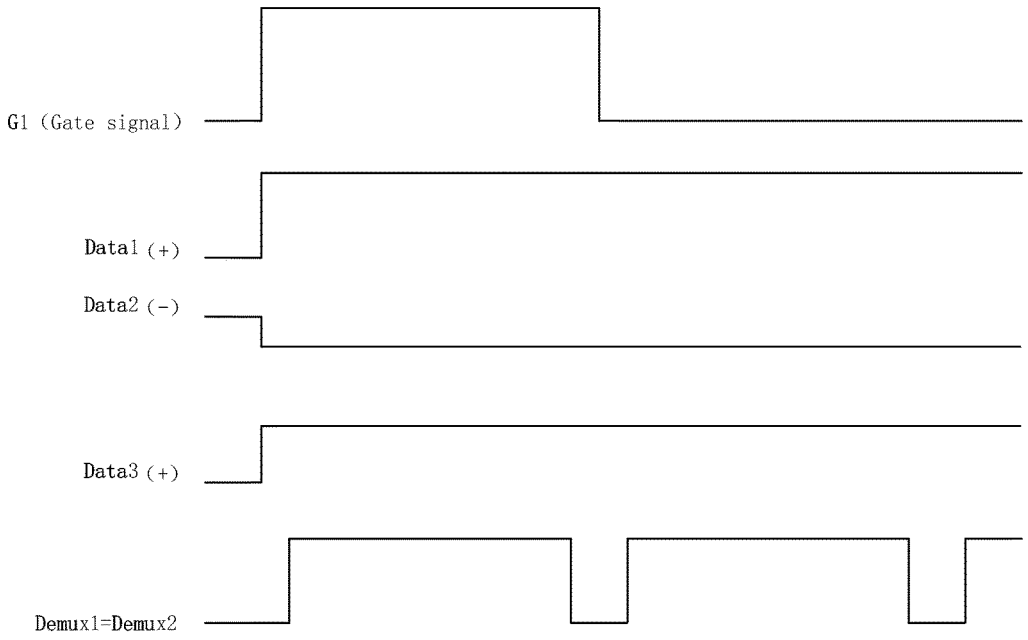
FIG. 8 is a schematic view showing the third driving signal under the power-saving mode for the high resolution demux driver circuit provided by a preferred embodiment of the present invention.

Refer to FIG. 8. FIG. 8 is a schematic view showing the third driving signal under the power-saving mode for the high resolution demux driver circuit provided by a preferred embodiment of the present invention. As seen in FIG. 8, Demux1 and Demux2 are shared, and are the same signal. Also, within the duration of each gate signal, the mux module switches on and off once.

The high resolution demux driver circuit of the present invention, when in power-saving mode does not need to change the voltage of the Data signal so that the power saving efficiency is high. Also, in FIGS. 7 and 8, the number of control signals provided by the IC to the demux can be saved, and in FIG. 8, the frequency of demux control signal is further reduced for more power saving.

In summary, the present invention provides a high resolution demux driver circuit, wherein the data signal does not change voltage in a power-saving mode. Therefore, a high power-saving efficiency can be achieved. Moreover, the number of control signals is reduced as well as the frequency controlling the control signals for further power-saving.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A high resolution demultiplexer (demux) driver circuit, which comprises: a plurality of scan lines connected respectively to row of sub-pixels, a plurality of data lines connected respectively to columns of sub-pixels and supplying data signals to the columns of sub-pixels respectively, and a plurality of multiplexer (mux) modules, which comprises a first mux module, a last mux module, and intermediate mux modules, each of of the plurality of mux modules comprising two thin film transistors (TFTs), with the gates of the TFTs connected respectively to a first shunt control signal and a second shunt control signal, the sources of the TFTs connected to a same data signal, and the drains of the TFTs connected to the plurality of data lines such that for each of the intermediate mux modules, the drains of the two TFTs are connected respectively to the data lines of two adjacent same color sub-pixel columns and for each of the first and last mux modules, the drain of a first one of the two TFTs is connected to one of the data lines and the drain of a second one of the two TFTs is set vacant, wherein the sub-pixel columns includes a first sub-pixel column and a last sub-pixel column and intermediate sub-pixel columns arranged between the first and last sub-pixel columns arranged in a horizontal direction and polarities of the data signals are supplied to the intermediate sub-pixel columns so that displaying made with the intermediate sub-pixel columns follows a polarity distribution pattern of alternating positive-positive and negative-negative in the horizontal direction;

wherein in a power-saving mode, the first shunt control signal and the second shunt control signal are one common signal.

2. The high resolution demux driver circuit as claimed in claim 1, wherein the high resolution demux driver circuit is connected to and drives an RGB-based display panel.

3. The high resolution demux driver circuit as claimed in claim 2, wherein when the high resolution demux driver circuit operates in a power-saving mode, red, green, and blue colors of each sub-pixel color exhibit 240, 127 and 30 color levels, respectively.

4. The high resolution demux driver circuit as claimed in claim 1, wherein within a duration of each gate signal, the mux module switches on and off once.

5. The high resolution demux driver circuit as claimed in claim 1, wherein within a duration of each gate signal, the mux module switches on and off twice.

6. The high resolution demux driver circuit as claimed in claim 1, wherein displaying made with the intermediate sub-pixel columns follows a polarity distribution pattern of positive-positive followed by negative-negative in the horizontal direction.

7. The high resolution demux driver circuit as claimed in claim 1, wherein displaying made with the intermediate sub-pixel columns follows a polarity distribution pattern of negative-negative followed by positive-positive in the horizontal direction.

8. The high resolution demux driver circuit as claimed in claim 1, wherein the polarity of each data signal is distributed following alternating positive and negative.

9. A high resolution demultiplexer (demux) driver circuit, which comprises: a plurality of scan lines connected respectively to row of sub-pixels, a plurality of data lines connected respectively to columns of sub-pixels and supplying data signals to the columns of sub-pixels respectively, and a plurality of multiplexer (mux) modules, which comprises a first mux module, a last mux module, and intermediate mux modules, each of of the plurality of mux modules comprising two thin film transistors (TFTs), with the gates of the TFTs connected respectively to a first shunt control signal and a second shunt control signal, the sources of the TFTs connected to a same data signal, and the drains of the TFTs connected to the plurality of data lines such that for each of the intermediate mux modules, the drains of the two TFTs are connected respectively to the data lines of two adjacent same color sub-pixel columns and for each of the first and last mux modules, the drain of a first one of the two TFTs is connected to one of the data lines and the drain of a second one of the two TFTs is set vacant, wherein the sub-pixel columns includes a first sub-pixel column and a last sub-pixel column and intermediate sub-pixel columns arranged between the first and last sub-pixel columns arranged in a horizontal direction and polarities of the data signals are supplied to the intermediate sub-pixel columns so that displaying made with the intermediate sub-pixel columns follows a polarity distribution pattern of alternating positive-positive and negative-negative in the horizontal direction;

wherein in a power-saving mode, the first shunt control signal and the second shunt control signal are one common signal;

wherein the high resolution demux driver circuit is connected to and drives an RGB-based display panel; and wherein the polarity of each data signal is distributed following alternating positive and negative.

10. The high resolution demux driver circuit as claimed in claim 9, wherein when the high resolution demux driver circuit operates in a power-saving mode, red, green, and blue colors of each sub-pixel color exhibit 240, 127 and 30 color levels, respectively.

11. The high resolution demux driver circuit as claimed in claim 9, wherein within a duration of each gate signal, the mux module switches on and off once.

12. The high resolution demux driver circuit as claimed in claim 9, wherein within a duration of each gate signal, the mux module switches on and off twice.

13. The high resolution demux driver circuit as claimed in claim 9, wherein displaying made with the intermediate sub-pixel columns follows a polarity distribution pattern of positive-positive followed by negative-negative in the horizontal direction.

14. The high resolution demux driver circuit as claimed in claim 9, wherein displaying made with the intermediate sub-pixel columns follows a polarity distribution pattern of negative-negative followed by positive-positive in the horizontal direction.

* * * * *